United States Patent [19]

Cunningham

[11] Patent Number: 4,672,763

[45] Date of Patent: Jun. 16, 1987

[54] SAFETY DEVICE FOR PREVENTING THE UNAUTHORIZED FIRING OF A WEAPON BY RELEASING THE HAMMER SPRING

[76] Inventor: Jerry M. Cunningham, Rte. 3, Box 434P, Fort Worth, Tex. 76140

[21] Appl. No.: 898,633

[22] Filed: Aug. 21, 1986

[51] Int. Cl.[4] ..... F41C 17/00

[52] U.S. Cl. ..... 42/70.11; 42/66; 42/70.01

[58] Field of Search ..... 42/65, 66, 69.01, 69.03, 42/70.01, 70.08, 70.11

[56] References Cited

U.S. PATENT DOCUMENTS

| | | | |
|---|---|---|---|
| 875,469 | 12/1907 | Tambour | 42/70.01 |
| 905,020 | 11/1908 | Tambour | 42/70.01 |
| 2,945,316 | 7/1960 | Mulno | 42/66 |
| 3,984,934 | 10/1976 | Weiss | 42/70.01 |
| 4,003,152 | 1/1977 | Barker et al. | 42/70.01 |
| 4,067,132 | 1/1978 | Smith | 42/66 |
| 4,135,320 | 1/1979 | Smith | 42/70.01 |
| 4,154,014 | 5/1979 | Smith | 42/70.01 |

*Primary Examiner*—Deborah L. Kyle
*Assistant Examiner*—Ted L. Parr
*Attorney, Agent, or Firm*—James E. Bradley

[57] ABSTRACT

A safety device for preventing the unauthorized firing of a weapon, such as a pistol. The device has a hammer, a handle, and a leaf spring inside of the handle. The leaf spring places tension on the hammer, when the weapon is enabled. The leaf spring is held by a stop member, which is movable. When the stop member is moved to a lower position, the spring is released, and the weapon is disabled. The stop member is moved by a strap and a ring, connected to the stop member. The handle must be taken apart in order to return the spring and the stop member to the enabled condition.

8 Claims, 2 Drawing Figures

SAFETY DEVICE FOR PREVENTING THE UNAUTHORIZED FIRING OF A WEAPON BY RELEASING THE HAMMER SPRING

BACKGROUND OF THE INVENTION

1. Field of the Invention

This invention relates in general to the field of weaponry. In particular, the invention relates to safety devices for preventing the unauthorized firing of a weapon.

2. Description of the Prior Art

There is a concern for the safety of law enforcement officers, because of the possibility of an officer being disarmed during an altercation and threatened with the officer's own weapon. There is also a concern for the safety of children in a home where a weapon may be stored when not in use. Ordinary safeties, designed to prevent accidental firing of the weapon, are inadequate protection against such an attack. Ordinary safeties must be easily released or the use of the weapon is impaired.

U.S. Pat. Nos. 4,067,132; 4,135,320; and 4,154,014 show a safety device which requires the user to have a magnetic ring on the finger of the gun-gripping hand, or the weapon cannot be fired. Thus, the officer must either wear the ring at all times, or put the ring on before the weapon can be fired. This can be dangerous, and it is at least inconvenient. There is also a possibility that an attacker can gain control of both the gun and the ring, and then use the gun on the officer.

SUMMARY OF THE INVENTION

The safety device of the invention prevents the unauthorized use of a weapon by disabling the weapon. The weapon is disabled by pulling on a strap or lanyard which is attached to the weapon. Once the weapon has been disabled, a cover plate on the handle of the weapon must be removed before the weapon can be enabled.

The invention is useful in a weapon, such as a revolver, which has spring for placing tension on a hammer. The spring is held in tension by a stop member. The stop member can be moved, releasing the tension on the spring, and allowing the spring to move freely. The spring cannot be placed back in tesnion without removing one of the cover plates on the handle of the weapon.

The stop member may be connected to a ring, to which a strap or lanyard may be attached. The officer can disable the weapon by pulling on the strap. This moves the stop member away from the spring, releasing the tension on the spring.

The invention has additional objects, features, and advantages. These will become apparent in the following detailed description.

DESCRIPTION OF THE PREFERRED EMBODIMENT

Figure 1:
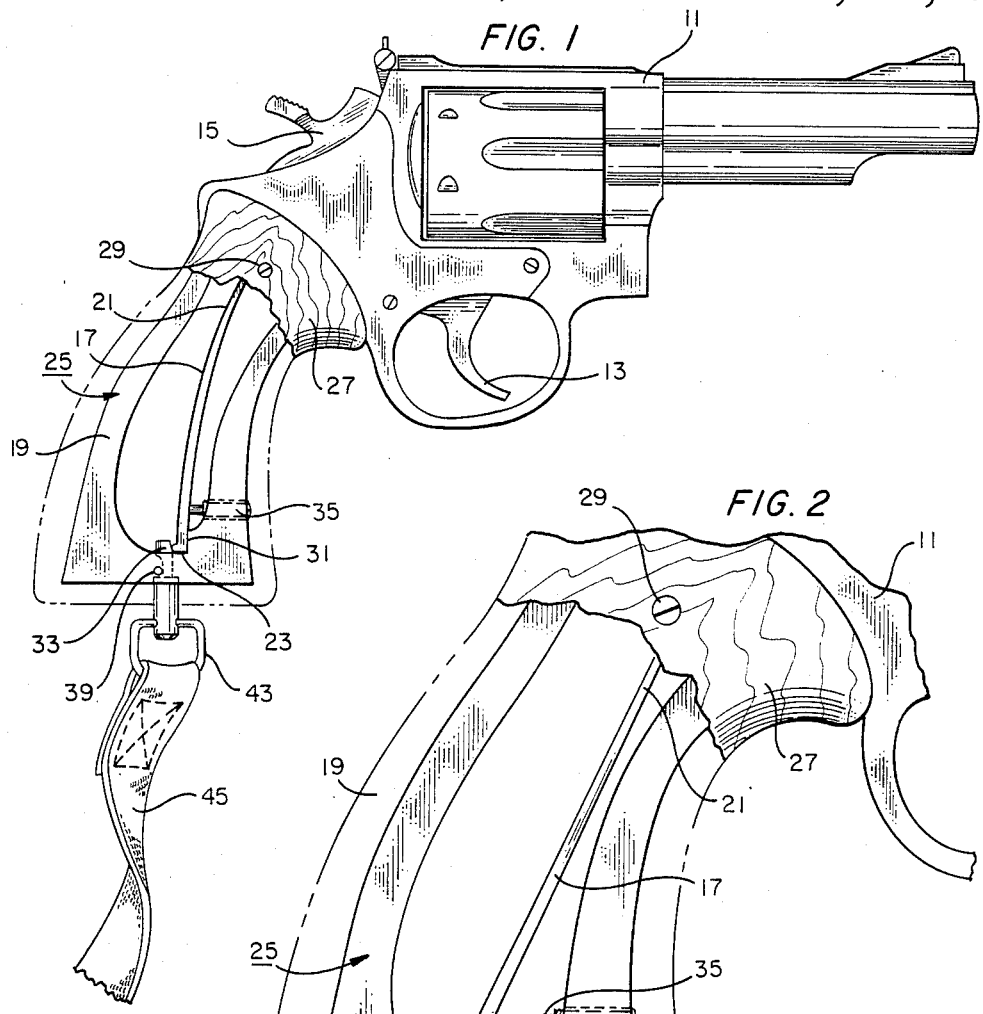
FIG. 1 is a side view, partially in section, of a weapon, incorporating a safety device of the invention.

The drawings show a preferred embodiment of the invention, as the invention would be used on a revolver

11. The invention might also be used on other types of weapons, such as an automatic pistol or a rifle. The revolver 11 shown in the drawings is a conventional weapon, having a trigger 13 and a hammer 15. When the trigger 13 is pulled, the hammer 15 is pulled back and released to fire the revolver 11.

When the hammer 15 is released, a leaf spring 17 forces the hammer 15 forward. The leaf spring 17 is located in the handle 19, or grip, of the revolver 11. The leaf spring 17 is a long, thin piece of metal, having an upper end 21 and a lower end 23, and extends downward from the hammer 15 into the handle 19.

The handle 19 includes a hollow metal frame 25, which depends from the remaining portion of the revolver 11. The metal frame 25 is covered by two cover plates 27, which are releasably mounted to the frame 25 by one or more screws 29. The cover plates 27 thus give access to the interior of the handle 19.

The frame 25 has a shoulder 31 to restrict the movement of the lower end 23 of the spring 17 in a forward direction. However, the hollow frame 25 is milled out behind the spring 17 and allows the lower end 23 of the spring 17 to move freely in a rearward direction, unless the lower end 23 of the spring 17 is restrained.

Figure 2:
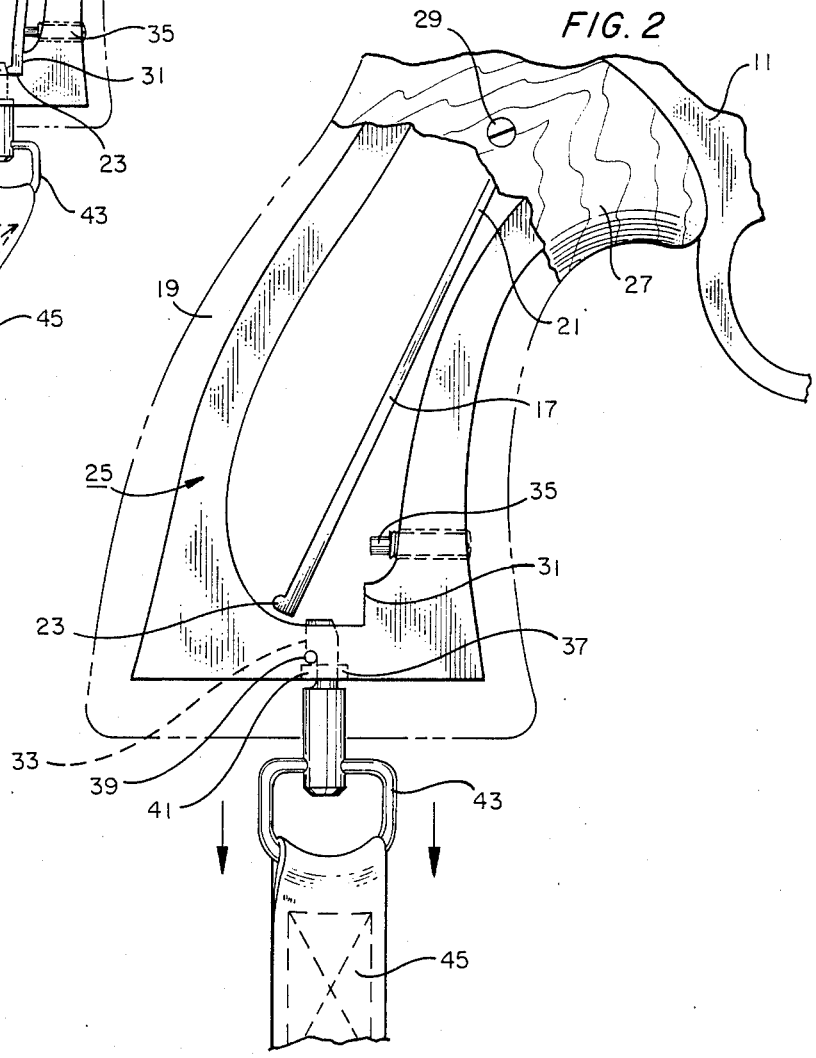
FIG. 2 is a side view, partially in section, of a portion of the weapon shown in FIG. 1, with the weapon disabled.

FIG. 1 shows the revolver in the enabled condition, and FIG. 2 shows the revolver 11 in the disabled condition. In the enabled condition, shown in FIG. 1, the lower end 23 of the spring 19 is restrained by a stop member 33.

A set screw 35, mounted in the handle 19, exerts a force on the spring 17, to place tension on the spring 17. The set screw 35 can be turned to adjust the amount of tension placed on the leaf spring 17.

The stop member 33 is a generally cylindrical pin, which extends through a passage 37 through the bottom of the handle 21. The stop member 33 is axially movable between an engaged upper position, shown in FIG. 1, and a released lower position, shown in FIG. 2.

A roll pin 39, mounted in the housing 19, extends through a cut out portion 41 of the stop member 33. The roll pin 39 allows the stop member 33 to move axially between the upper and lower positions, but the roll pin 39 is a keeper means for preventing the stop member 33 from falling out of the weapon 11.

A metal ring 43 is attached to the stop member 33, and a strap or lanyard 45 is connected to the ring 43. The ring 43 and the strap 45 are a release means for moving the stop member 33 from the upper position to the lower position. The strap or lanyard 45 may be attached to a belt worn by the officer, or the strap may extend around the officer'shoulder.

As shown in FIG. 2, when the stop member 33 is in the lower position, the lower end 23 of the spring 17 is released and can move freely. The tension is removed from the spring 17 and from the hammer 15. When the revolver 11 is in this disabled condition, pulling the trigger 13 will not fire the weapon 11.

In operation, the officer carries the revolver 11 in the enabled condition, shown in FIG. 1, with the strap 45 secured around the officer's shoulder or to the officer's belt. The weapon 11 is ready for use, and can be easily used by the officer.

If, however, the officer is involved in an altercation, and the revolver 11 is grabbed by another person, the officer can easily disable the weapon 11. The officer merely pulls on the strap 45, which pulls the stop member 33 down to the lower position. The leaf spring 17 is released, the tension on the spring 17 and the hammer 15 is removed, and the weapon 11 cannot fire.

Furthermore, the person who grabbed the gun 11 cannot easily return the gun 11 to the enabled condition. The cover plate must be removed from the handle 19, before lower end 23 of the spring 17 can be placed behind the stop member 33.

The safety device of the invention has several advantages over the prior art. The weapon 11 can be easily disabled, even during a scuffle, by pulling on the strap 45. Once the weapon 11 has been disabled, the gun 11 cannot be easily returned to the enabled condition.

The invention has been shown in only one of its forms. It should be apparent to those skilled in the art that it is not so limited, but is susceptible to various changes and modifications without departing from the spirit thereof.

I claim:

1. A safety device for preventing unauthorized firing of a weapon, comprising:

a hammer;

a hollow handle depending from the weapon;

at least one cover, releasably mounted to the handle for providing access to the interior of the handle;

a spring, that engages the hammer, for placing tension on the hammer;

a stop member, in the handle, the stop member being movable from an engaged position, in which the stop member holds the spring in tension, to a released position in which the stop member releases the tension of the spring; and release means, actuated from the exterior of the handle, for moving the stop member to the released position to disable the weapon, the stop member being movable again to the engaged position only by removing the cover of the handle and resetting the spring against the stop member.

2. A safety device for preventing unauthorized firing of a weapon, as recited in claim 1, wherein the stop member is located in a passageway extending into the handle and has an exterior portion that protrudes from the handle for actuation to the released position.

3. A safety device for preventing unauthorized firing of a weapon, as recited in claim 1, wherein the spring has a lower end, which is biased in a rearward direction and is located on the forward side of the stop member when the stop member is in the engaged position, and when the stop member is in the released position, the lower end of the spring moves to a position rearward of the stop member.

4. A safety device for preventing unauthorized firing of a weapon, comprising:

a hammer;

a depending hollow handle;

a leaf spring, having an upper end that engages the hammer for placing tesion on the hammer, and a lower end that extends downward in the handle;

a stop member, extending into the lower end of the handle, for holding the spring in tension, the stop member being manually movable from the exterior of the handle from an engaged upper position bearing against the lower end of the spring to maintain the spring in tension, to a released lower position in which the stop member allows the lower end of the spring to move rearward to release tension on the spring and prevent unauthorized firing; and the stop member being movable back to the engaged position bearing against the spring only by removing the cover and pressing the lower end of the spring forward and into contact with the stop member.

5. A safety device for preventing unauthorized firing of a weapon, as recited in claim 4, further comprising keeper means for preventing the stop member from falling out of the weapon when in the released position.

6. A safety device for preventing unauthorized firing of a weapon, as recited in claim 4, further comprising a ring and a strap connected to the exterior end of the stop member, for facilitating movement of the stop member to the lower position when in danger of losing the weapon to an assailant.

7. A safety device for preventing unauthorized firing of a weapon, comprising:

a hammer;

a hollow handle depending from the weapon;

a leaf spring, having an upper end that engages the hammer for placing tension on the hammer, and a lower end that extends downward in the handle;

a stop member, mounted in a passage in the lower end of the handle and extending into the handle, for holding the spring in tension, the stop member being axially movable from an engaged upper position, bearing against the lower end of the spring to maintain the spring in tension, to a released lower position in which the stop member allows the lower end of the spring to move rearward to release tension on the spring and prevent unauthorized firing; and the stop member being movable back to the engaged position bearing against the spring only by removing the cover and pressing the lower end of the spring forward and into contact with the stop member.

8. A method for preventing unauthorized firing of a weapon, comprising the steps of:

manufacturing a weapon, having a hammer and a hollow handle depending from the weapon;

releasably mounting at least one cover to the handle for providing access to the interior of the handle;

mounting a spring in the handle, the spring having an upper end that engages the hammer, for placing tension on the hammer, and a lower end that extends downward through the handle;

mounting a stop member in the handle, for holding the spring in tension, the stop member being movable from an engaged position bearing against the lower end of the spring, to a released position in which the lower end of the spring moves outward from the stop member to release tension of the spring;

moving the stop member to the released position to disable the weapon;

removing the cover of the handle; and resetting the lower end of the spring against the stop member.

* * * * *